US005863369A

United States Patent [19]

Clarke et al.

[11] Patent Number: 5,863,369

[45] Date of Patent: Jan. 26, 1999

[54] CONTINUOUS MOULDINGS AND METHODS OF PRODUCTION THEREOF

[75] Inventors: Rodney Charles Clarke, Birkdale; Paul Rodney Clarke, Jimboomba, both of Australia

[73] Assignee: Dreamtank Pty Ltd, Eight Mile Plains, Australia

[21] Appl. No.: 716,195

[22] PCT Filed: Mar. 31, 1995

[86] PCT No.: PCT/AU95/00186

§ 371 Date: Oct. 31, 1996

§ 102(e) Date: Oct. 31, 1996

[87] PCT Pub. No.: WO95/27110

PCT Pub. Date: Oct. 12, 1995

[30] Foreign Application Priority Data

Mar. 21, 1994 [AU] Australia ..... PM4826

[51] Int. Cl.[6] ..... B65H 37/04

[52] U.S. Cl. ..... 156/201; 156/213; 156/478

[58] Field of Search ..... 156/40, 44, 200, 156/201, 202, 212, 213, 216, 347, 348, 475, 478, 477.1; 264/173.1

[56] References Cited

U.S. PATENT DOCUMENTS 4,539,169 9/1985 Nixon et al. ..... 264/173.1

4,612,152 9/1986 Kawabata et al. ..... 264/173.1 X 5,171,499 12/1992 Cehelik et al. ..... 264/173.1 X

*Primary Examiner*—Francis J. Lorin

*Attorney, Agent, or Firm*—Oppenheimer Wolff & Donnelly LLP

[57] ABSTRACT

There is provided architectural molding apparatus including a supporting frame assembly and a paper roll assembly which delivers a continuous paper web via tension and drive rollers to an adhesive applicator where hot melt pressure sensitive adhesive is deposited on the web. The glue coated paper web passes over roller to a profiled polystyrene core at a set-up roller assembly. The core is delivered by a core feed assembly which is adapted to receive lengths of the core in abutting relation. The set-up roller assembly receives the core and urges the paper web glue side first into the core to form the molding assembly which passes to a laminating roller assembly adapted to urge the glue covered web into intimate contact with the profile face of the core. The molding assembly then passes to a series of rollers adapted to progressively fold and roll the web to completely wrap the core. The molding assembly then passes to a finishing roller assembly, a consolidating roller assembly and a final finishing roller, to ensure bonding integrity between the web and the core. The finished molding assembly passes to a flying shear assembly adapted cut the continuous molding assembly.

10 Claims, 10 Drawing Sheets

CONTINUOUS MOULDINGS AND METHODS OF PRODUCTION THEREOF

This invention relates to continuous mouldings and methods of production thereof.

BACKGROUND OF THE INVENTION

This invention has particular but not exclusive application to production of continuous cornice and the like, and for illustrative purposes reference will be made to such application. However, it is to be understood that this invention could be used in other applications, such as in production of skirting mouldings and other substantially continuous architectural mouldings.

Traditionally and prior to the introduction of paper faced plaster products, cornices for use in conjunction with wall plaster or plaster board was moulded from fibrous plaster. Fibrous plaster cornices can adopt complex patterns and shapes but the material is heavy and brittle, requires skilled installation, and is labour intensive. The material is also porous and generally somewhat pitted and accordingly cannot be readily spray-painted, since the liquid binder in the paint is absorbed rapidly into the porous surface.

The advent of paper covered plaster cornice and its relative ease of fixing and handling has made this material ubiquitous in the domestic and commercial plastering trade. The paper coated cornice at least partially overcomes the disadvantage of limitation of painting methods of fibrous plaster cornices but the process of manufacture severely limits the shapes and sizes which can be produced. The material, being based on reinforced plaster, is still heavy, resulting in difficulties in shifting and transport. Whilst the material is more flexible than fibrous plaster mouldings, excessive flexing of the cornice under its own weight will cause damage to the plaster core and disrupt the surface form of the cornice. Accordingly, it still requires several pairs of hands to install, particularly for long runs of the cornice.

The limitation on shapes and sizes of paper covered cove cornice is imposed by the technical constraints of manufacture. The cornice is made by means of a wet plaster process where uncured plaster slurry is formed and extruded onto a cove shape to form the shape prior to initial set of the plaster. Mechanical apparatus then folds over the paper coating and the continuously produced cove is cut to length.

The present invention aims to substantially alleviate at least one of the above disadvantages and to provide continuous mouldings and methods for production thereof which will be reliable and efficient in use. Other objects and advantages of this invention will hereinafter become apparent.

With the foregoing and other objects in view, this invention in one aspect resides broadly in a method for producing continuous architectural mouldings including the steps of:

providing a moulding core member having an outer surface formed to a selected profile;

providing a continuous moulding cover member;

adhesively laminating said core member and said cover member by laminating means having a working surface of profile complementary to said outer surface.

The moulding core member may be provided as a substantially continuous material or may be handled in discrete lengths. The moulding core member may be of any suitable material including thermoplastic or thermoset polymeric foam materials, extruded plastic material, wood such as red cedar, or the like. Preferably the material is selected for lightness with sufficient stiffness either of itself or in laminate with the cover member to be handled in convenient lengths. Preferably, the material is selected such that some flexibility or resilience is maintained to accommodate some building movement when installed as an architectural moulding. Preferably, the material is selected from open cell or closed cell foams of polystyrene for its ease of thermoforming or abrasive forming.

The core member may be formed by any suitable means such as by continuous grinding to profile or, in the case of the preferred polystyrene foam, by hot wire cutting. Preferably, the selected profile is selected to be complementary with itself such that pairs of finished moulding may be stacked face to face to protect the paintable surface thereof in transport and handling. If the profiles are cut by hot wire cutting, the profile may be selected such that complementary surfaces as preferred are formed from a single length of stock material.

This feature of providing complementary profile faces is particularly advantageous since it eliminates the need for interstitial protective packing to prevent damage in shipping. Accordingly, in a further aspect this invention resides broadly in a cornice moulding having a face surface, a reverse surface and a pair of mounting surfaces therebetween, the profile of said moulding being selected such that a pair of mouldings may be stacked in face to face relation whereby the faces are substantially in mutual protective contact.

The surfaces of the moulding core member may be of any suitable form and will generally be determined by the purpose to which the architectural moulding is to be put. For example, for use as a cornice the moulding core member preferably comprises a pair of mounting surfaces disposed at 90° to one another and adapted to conform to wall and ceiling. These mounting surfaces are preferably configured such that face to face pairs form an assembly in stacking that may interlock with adjacent pairs to form a stack of optimised packing density, preferably without interstitial packing between pairs.

For example, the pairs may be laid adjacent with alternate pairs supported on a half thickness spacer whereupon the adjacent edge portions overlap to substantially eleminate dead space, whereupon the pack may be built up at maximum density and with maximum mutual protection of the mouldings.

The core member may be relieved between these surfaces on the back of the core member to save material and to accommodate obstructed wall/ceiling junctions. Preferably, this reverse surface is flat and configured such that the respective reverse surfaces of face to face mouldings are substantially parallel such that pairs may be stacked one on top of the other.

The cover member material may be at any suitable form such as thin metal such as aluminum, sheet plastic material such as polyethylene, polyester or PVC or paper or cardboard. The sheet material may for example be selected from calendared or uncalendared plaster board facing paper, unbleached paper, or the like. Preferably, such paper cover member material has least the displayed surface calendared, sized or sealed such that the surface may be painted without priming.

The continuous facing material may be pre-creased over creasing dies or wheels prior to being laminated to the shaped surface of the core member. Alternatively, the laminating means may work the cover member into the profile of the core member.

The adhesive bond of the cover member to the core member may be achieved by any suitable means. For example, the cover member may be passed an adhesive applicator which may spray or otherwise deposit an adhesive selected from contact adhesive, hot melt adhesive, inorganic (silicate) adhesive, pressure sensitive adhesive or the like. If necessary, the core member may be coated with the adhesive either in addition to or alternatively to the cover member. Preferably, the cover member is bonded to the core member by means of hot melt pressure sensitive adhesive distributed continuously to the surface in glue lines, dots or full cover along the cover member prior to laminating by the laminating means.

Alternatively, a laminate of the cover member, a pressure sensitive adhesive and release layer may be prepared as an assembly prior to continuous release layer stripping and application to the core member. The adhesive coated paper may be indexed with and rolled into a selected edge or groove of the profiled surface of the core member whereby an initial set-up of bond between the core member and the cover member is established. Upon initial set-up of the cover member and facing materials, the assembly may be passed to laminating means whereby the cover member may be worked into the profiled face of the core member.

In a further aspect, this invention resides broadly in apparatus for producing architectural mouldings including:

- feed means adapted to deliver a moulding core member having an outer surface formed to a selected profile;
- continuous supply means for a continuous moulding cover member;
- adhesive application means adapted to apply adhesive to a surface of said continuous moulding cover member;
- laminating means adapted to continuously laminate said core member and said cover member and having a working surface of profile complementary to said outer surface.

The laminating means may comprise a die, vacuum or mechanical press, roller assembly or the like. Preferably the laminating means comprises one or more roller assemblies including a roller having the shape of a solid of rotation of a profile complementary to that of the core member profile. The cover member is preferably of a width sufficient for the laminating means to completely wrap the cover member about the core member. Preferably, the laminating means comprises a plurality of roller stations adapted to progressively form the cover member about the core member. For example, the laminating means may comprise a first roller assembly adapted laminate the cover member to a key indexing portion of the core member to ensure accuracy, the so tacked moulding assembly passing to roller stations adapted to laminate the cover member to the full profile face of the core member. This may be followed by roller assemblies adapted to turn the cover member over the back of the core member prior to overlapping the edges of the cover member and pressing the moulding assembly to consolidate the adhesive with the components.

The cover member is preferably progressively worked about the sides and back of the core member by means of a sequence of dies or rollers forcing the paper about its creases up the sides and over the back of the core member material. Preferably, the respective edges of the facing material are sequentially folded onto the back of the core member material such that the second of the edges to be so folded overlaps the first to provide continuous coverage of the core member.

In a further aspect, this invention resides broadly in an architectural moulding including a core member having a cover member adhesively secured thereto, the architectural moulding having a profiled outer face and a mounting surface, said profiled outer surface being selected to be complementary to itself whereby mouldings may be laid in face to face contact. The ability to be laid in face to face contact provides that the architectural mouldings may be mutually protecting for storage and transportation, and have a maximized packing density thus reducing transport and storage volume in bulk.

Architectural mouldings such as cornice may have more than one mounting surface. Preferably such mouldings include mounting surfaces so disposed as to enable close packing of the pairs of mouldings. Similarly, architrave type mouldings may have side edged between the mounting surface and the profiled face which are preferably square to the mounting surface such the architrave may also be closely packed.

The architectural mouldings may be transported close packed and banded or may advantageously be shrink wrapped in convenient or job lot quantities.

BRIEF DESCRIPTION OF THE DRAWINGS

In order that this invention may be more readily understood and put into practical effect, reference will now be made to the accompanying drawings which illustrate a preferred embodiment of the invention and wherein.

DETAILED DESCRIPTION

Figure 1:
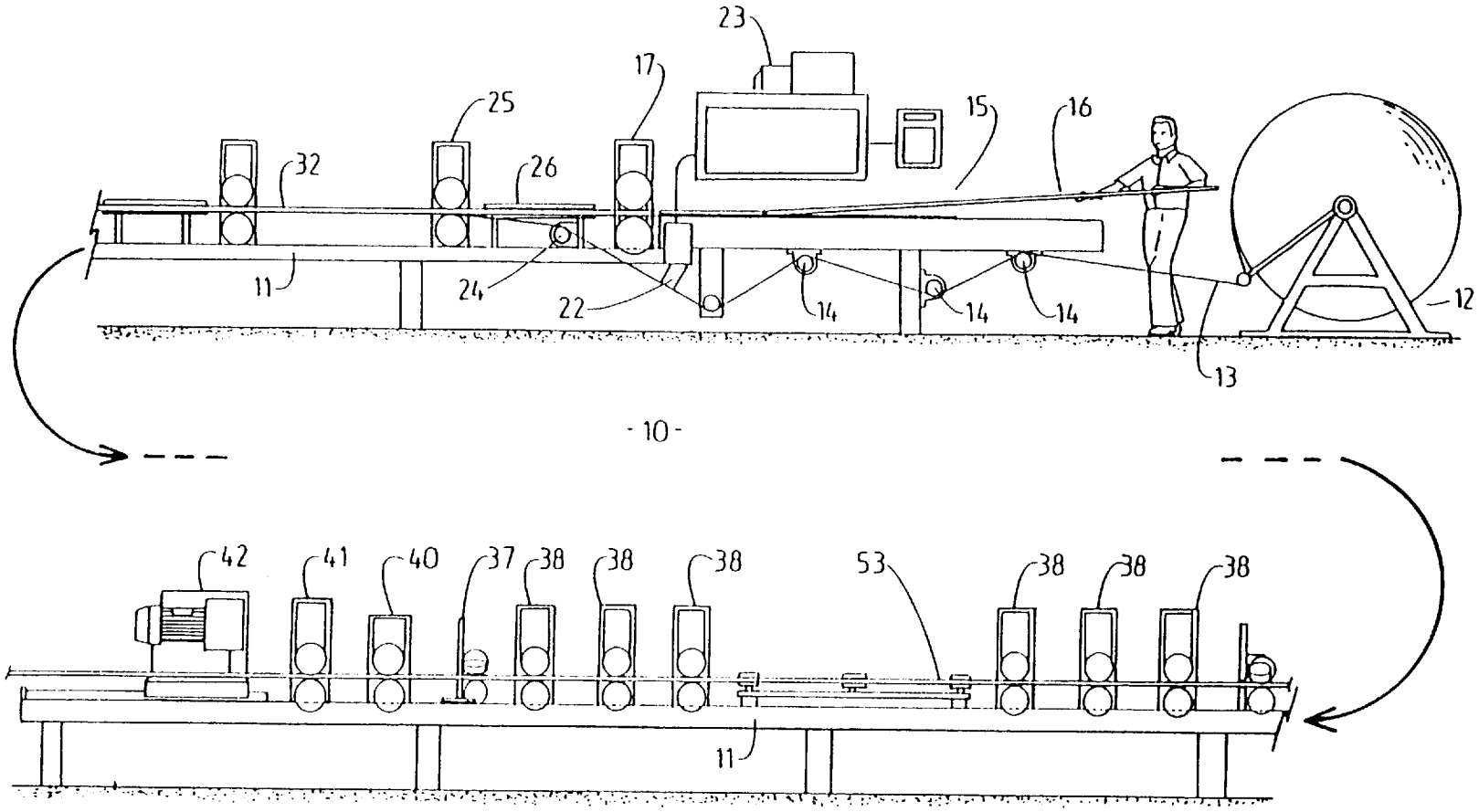
FIG. 1 is a side elevation of apparatus for production of architectural mouldings in accordance with the present invention.

In the figures there is provided architectural moulding apparatus 10 including a supporting frame assembly 11 and a paper roll assembly 12. The paper roll assembly 12 delivers a continuous paper web 13 to tension and drive rollers 14.

Figure 3:
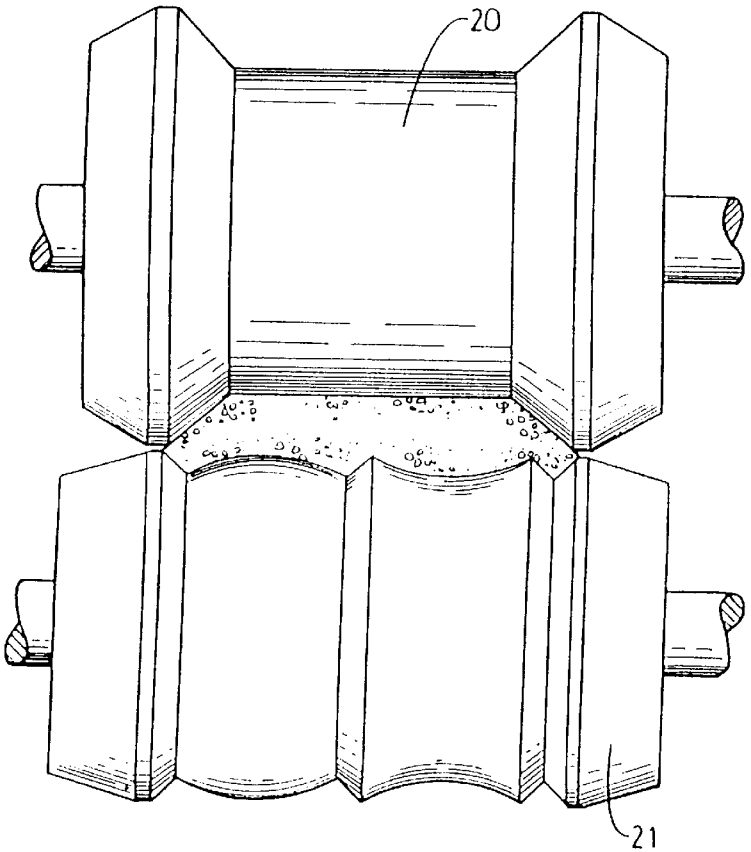
Figure 5:
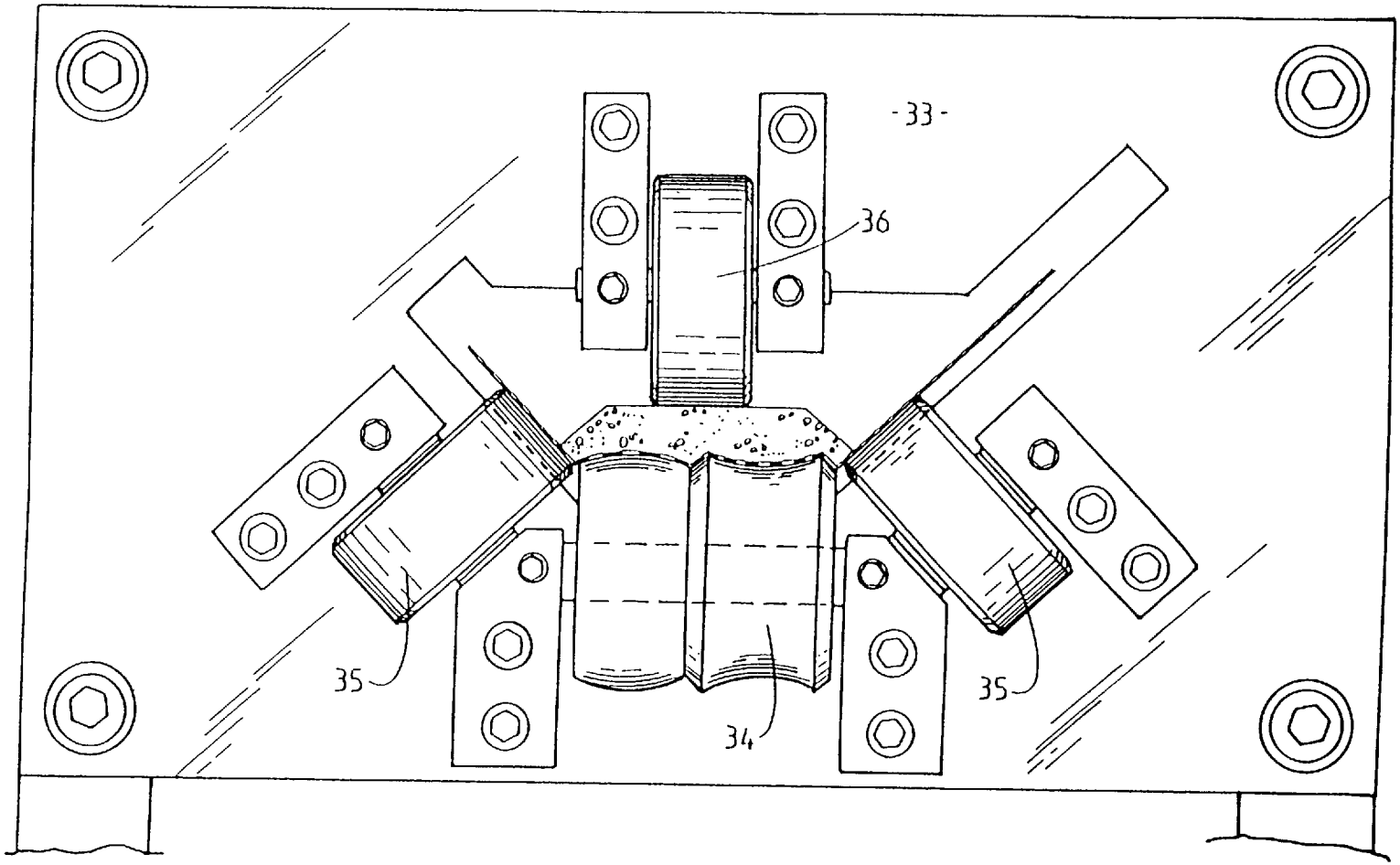
Figures 6, 7, 8:
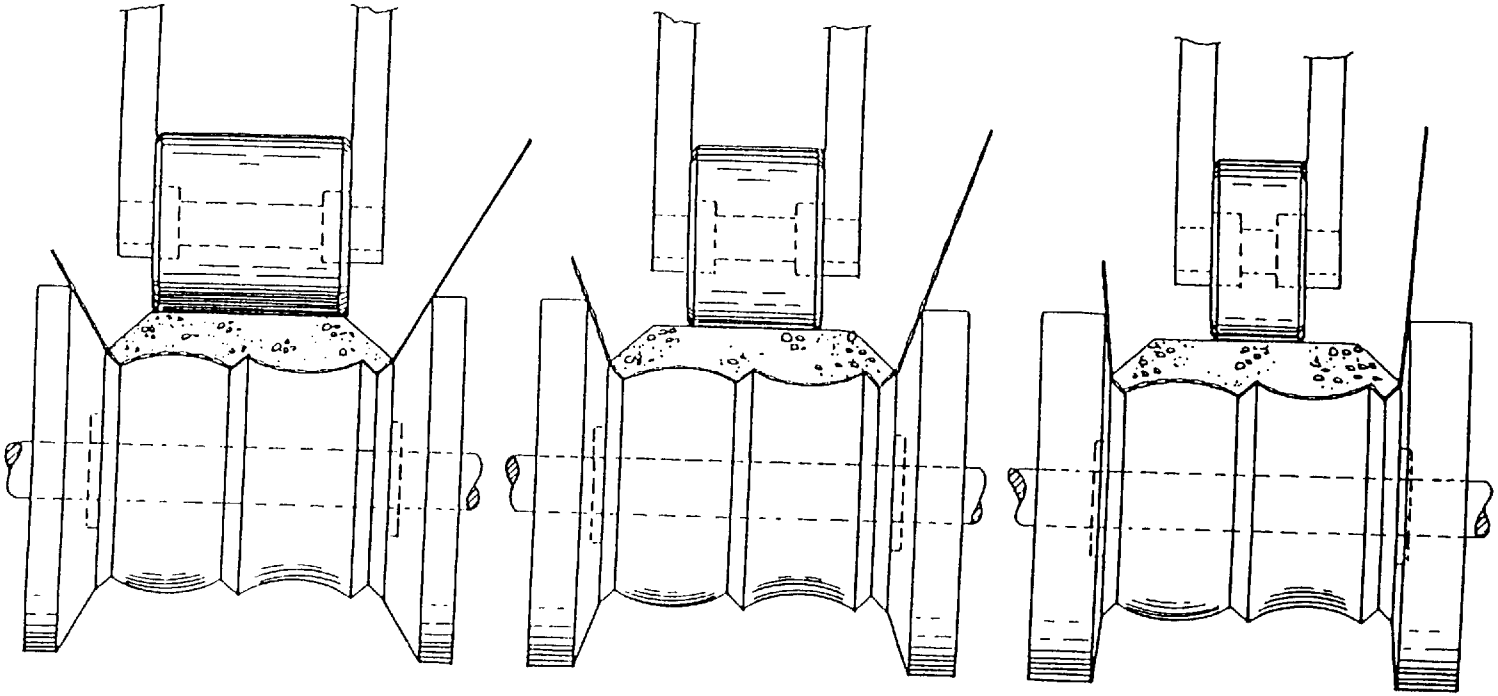
Figure 10:
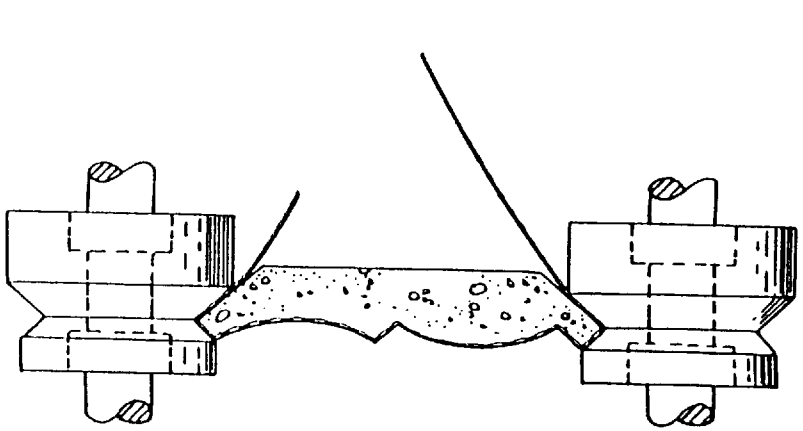
Figure 9:
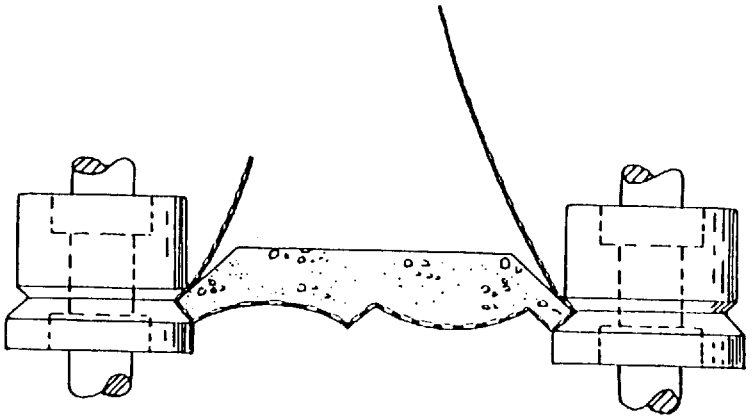
Figure 11:
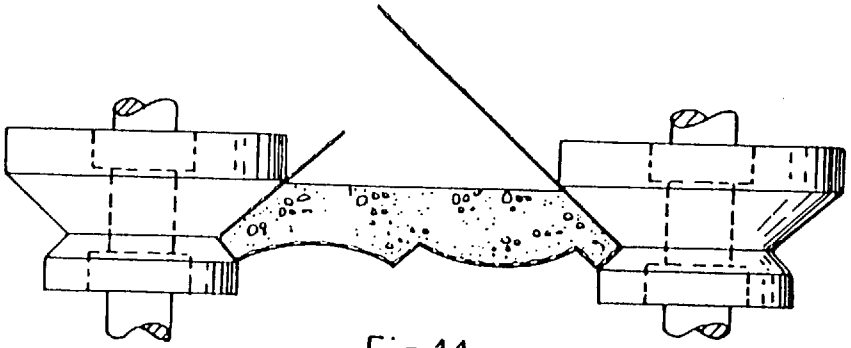
Figure 13:
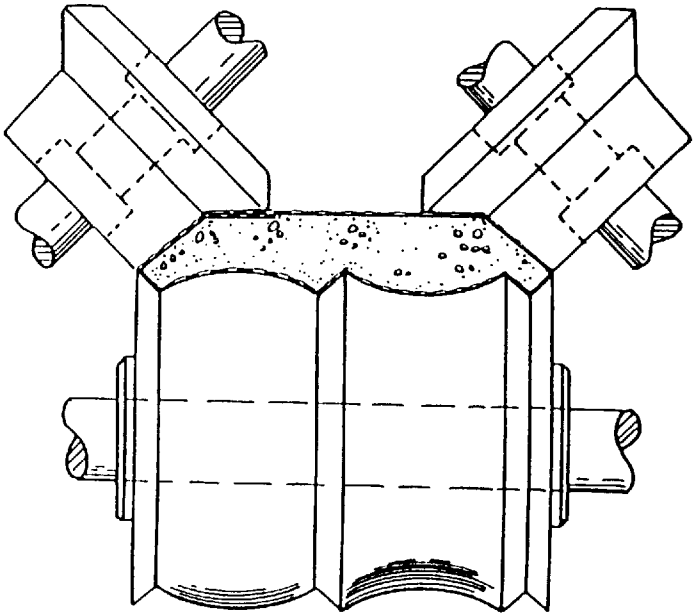
Figure 12:
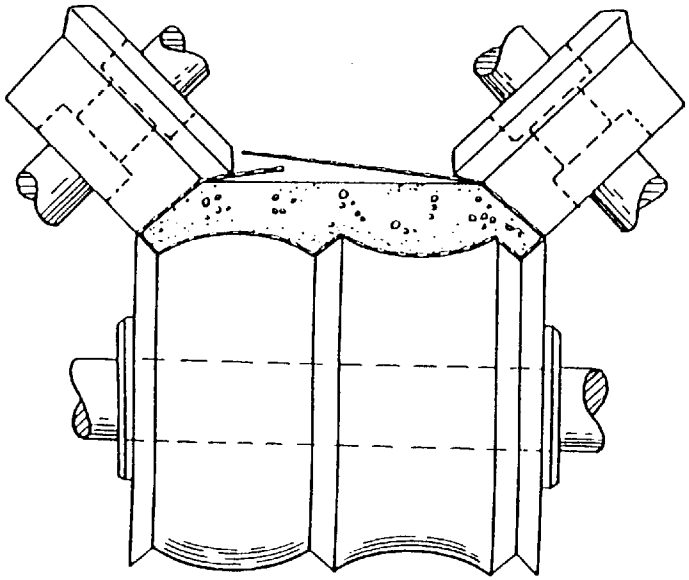
Figure 14:
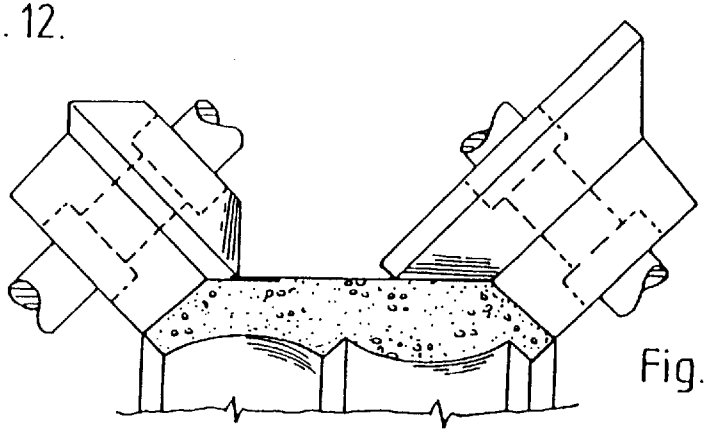
Figure 15:
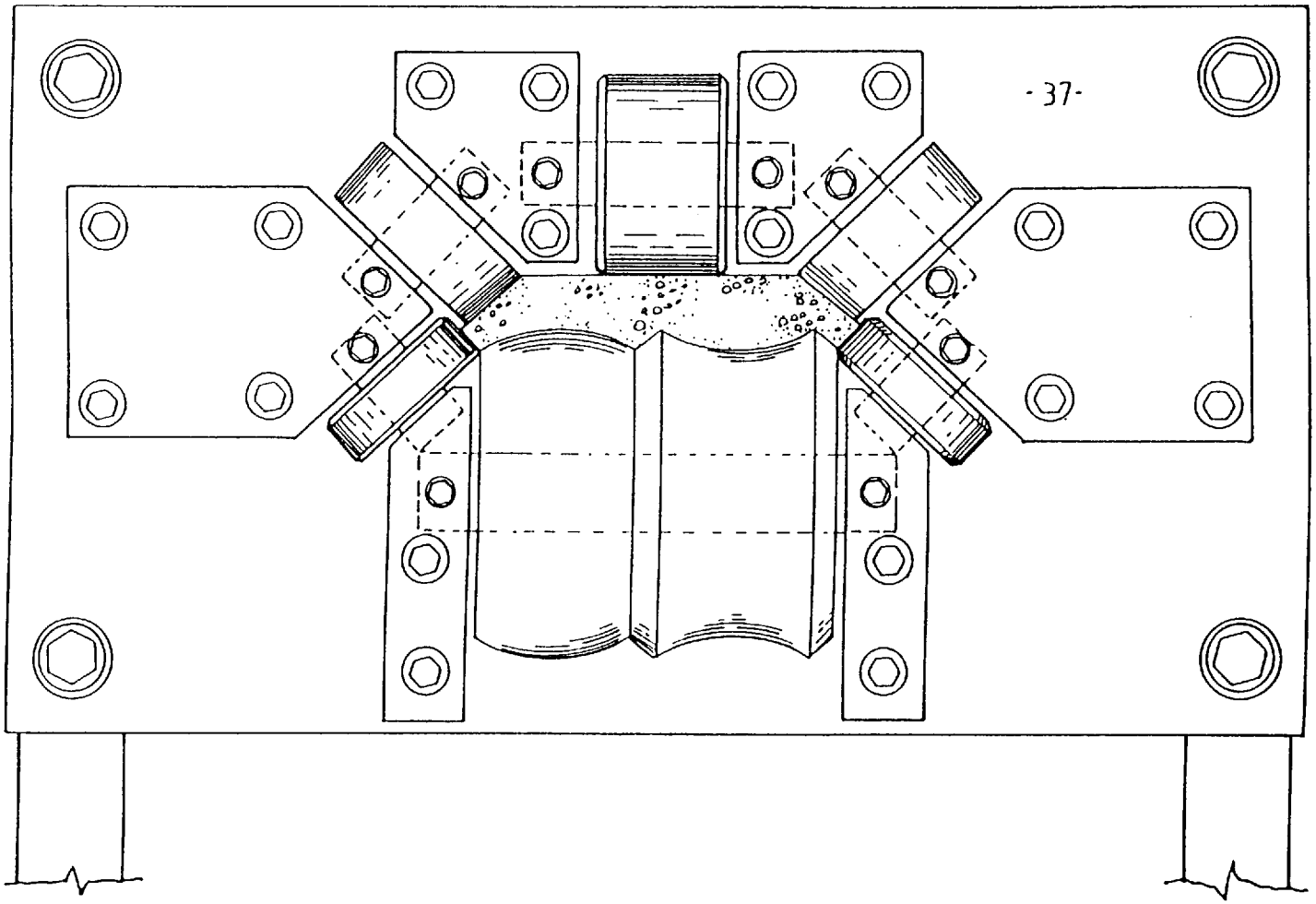
FIGS. 15 to 17 illustrate laminate consolidating components of the apparatus of FIG. 1.

A core feed assembly 15 is adapted to receive lengths of shaped polystyrene core 16. The core 16 is provided in lengths fed to the apparatus in abutting relation. The abutted lengths of shaped polystyrene core 16 are aligned in the architectural moulding apparatus 10 by means of an aligning roller assembly 17, illustrated in FIG. 3. The aligning roller assembly comprises an upper roller 20 conforming in shape to the profile of the back of the shaped polystyrene core 16 and a lower roller 21 conforming to the shape of the profiled face of the shaped polystyrene core 16.

Figure 4:
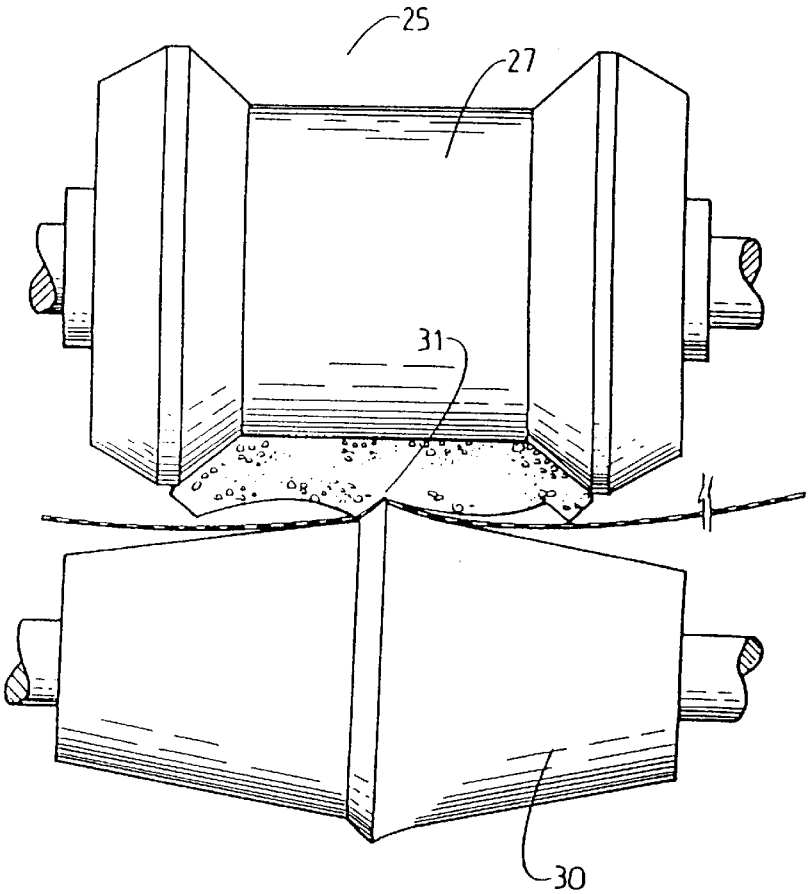
FIGS. 3 to 14 illustrate the progressive laminating components of apparatus in accordance with FIG. 1.

The continuous paper web 13 passes from the last of the tension and drive rollers 14 and through a glue applicator 22 adapted to receive hot melt pressure sensitive adhesive under pneumatic pressure from glue supply and control apparatus 23. The glue coated paper web passes over nylon aligning roller 24 to meet the shaped polystyrene core 16 at a set-up roller assembly 25. The set-up roller assembly receives the shaped polystyrene core through an antisag assembly 26. The set-up roller assembly, best illustrated in FIG. 4, comprises an upper roller 27 conforming to the shape of the back of the shaped polystyrene core 16 and a lower roller 30 adapted to urge the paper web 13 glue side first into a selected longitudinal groove 31 of the shaped polystyrene core 16 to form the moulding assembly 32.

The moulding assembly 32 then passes to a laminating roller assembly 33 having a lower laminating roller 34 adapted to urge the glue covered continuous paper web 13 into intimate contact with the profile face of the shaped polystyrene core 16 and having a pair of lateral rollers 35 adapted to fold and urge the glue covered continuous paper web 13 to side surfaces of the shaped polystyrene core 16. The lower laminating roller 34 and the lateral rollers 35 urge the continuous paper web against the respective surfaces of the shaped polystyrene core 16 against the reaction of a restraining roller 36.

The moulding assembly 32 then passes to a series of rollers 38 illustrated in FIGS. 6–14 which are adapted to progressively fold and roll the continuous paper web 13 to completely wrap the shaped polystyrene core 16.

Figure 17:
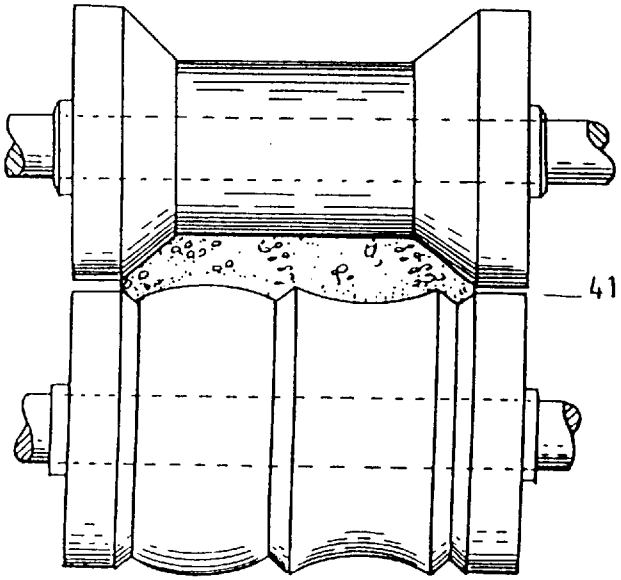
Figure 16:
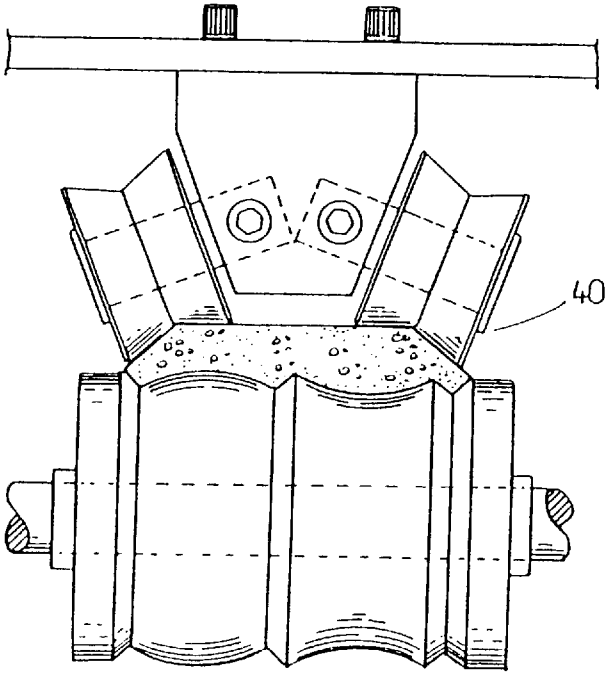

The moulding assembly 32 then passes to a finishing roller assembly 37 adapted to roll all surfaces of the moulding assembly 32 to ensure bonding integrity between the continuous paper web 13 and the shaped polystyrene core 16. Folds in the assembly are particularly consolidated by a consolidating roller assembly 40 best illustrated in FIG. 16 before passing to a final finishing roller 41 best illustrated in FIG. 17.

The finished moulding assembly 32 passes to a flying shear assembly 42 adapted to cut the continuous moulding assembly 32 into convenient lengths.

Figure 2:
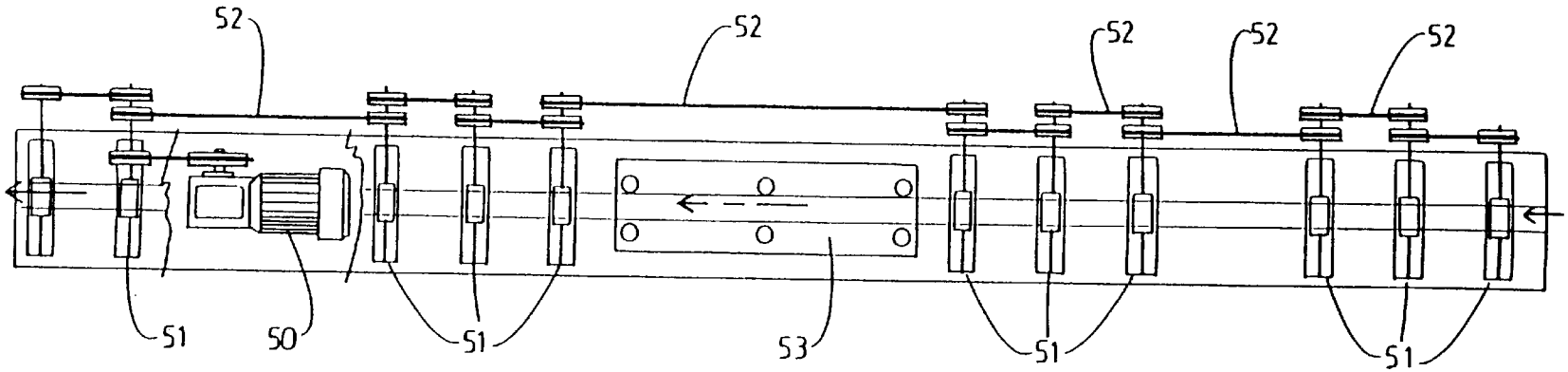
FIG. 2 is a partial plan view of the apparatus of FIG. 1.

FIG. 2 illustrates the plan view of typical drive arrangements of the apparatus of FIG. 1. The apparatus is powered by electric motor and gearbox assembly 50 adapted to drive the roller stations (collectively numbered 51 in this figure) via drive chains 52. Where necessary, the horizontal path is maintained by means of a lateral guide assembly 53.

Figure 18:
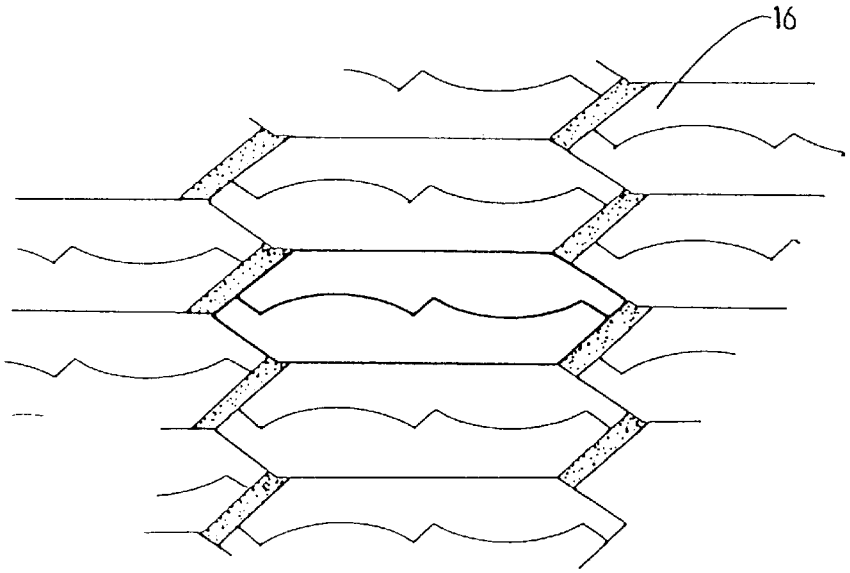

The core members 16 are formed from a polystyrene block 5 m×1.2 m×0.6 m, as illustrated in FIG. 18, of the required shape 2.5 m in length by a Wintec Hot Wire Shaping Machine. The design of the shapes are such to allow one pass of the hot wire to create two formed surfaces, hence halving the cutting time. The interlocking feature of shape also reduces waste.

Several wires are used, stretched horizontally across the cutting platform and fixed at even spacings to the vertical uprights each side of the cutting platform. The Wintec Shaping machine is controlled by computer and once the required shape is programmed, the wires move into the block of polystyrene moving simultaneously to clone the shaping process through the block.

The glue applicator 22 which the paper web 13 is drawn past is a "slot nozzle" device. The slot nozzle is fitted with a shim and by changing the shape of the shim, various glue patterns can be formed. Once the required glue pattern is created, the slot nozzle will, via heated feeder lines and under air pressure, apply hot melt pressure sensitive glue in an even flow to the paper surface. The glue is fed from a hot melt glue machine 23 comprised of a melt down reservoir and glue pump and the necessary controls to create the correct pressure and temperature.

Polystyrene sections are fed in and butted tight at joins. Once wrapped and glued, a continuous section is formed. Any required size may be cut from continuous product.

Figure 19:
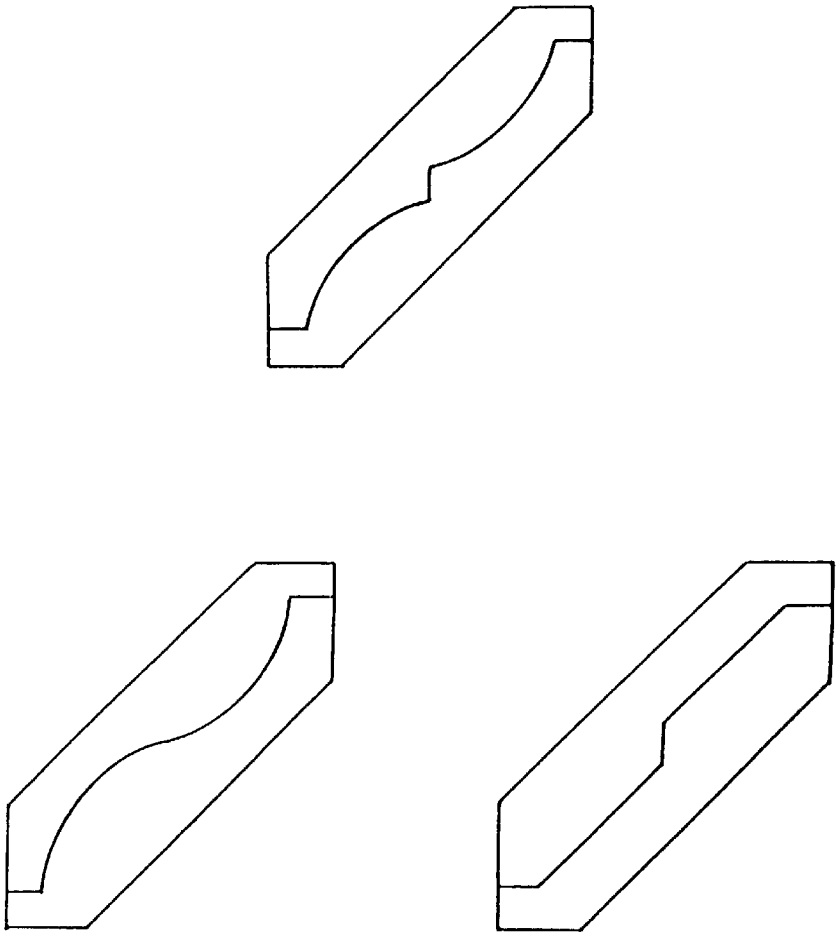
FIG. 18 is the wire cutting patterns for cornice core members produced in accordance with the present invention and FIG. 19 illustrates typical complementary stackable architectural mouldings in accordance with the present invention.

FIG. 19 illustrates three preferred sections of continuous moulding assembly 32, disposed in pairs and illustrating that the sections may be maintained in face to face contact.

The strength in paper covered plaster cornice is derived only from the paper outer surface. The plaster has no tensile strength at all without the paper. In the product produced in accordance with the present invention, the tensile strength is increased dramatically due the greatly reduced weight of the expanded polystyrene core as opposed to plaster, together with the superior tensile properties of the foam material. The expanded polystyrene cornice also offers the resilience required for movement in cornice attached to ceilings where roof truss method is used.

It will of course be realised that while the above has been given by way of illustrative example of this invention, all such and other modifications and variations thereto as would be apparent to persons skilled in the art are deemed to fall within the broad scope and ambit of this invention as defined in the claims appended hereto.

We claim:

1. A method for producing continuous architectural mouldings including the steps of:

providing a continuous lightweight foam core member of a selected profile;

adhesively laminating a continuous web of facing material about said core member, said web material being progressively worked about said core member by a plurality of laminating rollers having respective working surfaces complementary to at least a portion of said selected profile.

2. A method for producing continuous architectural mouldings according to claim 1, wherein said core member comprises open cell or closed cell foams of polystyrene.

3. A method for producing continuous architectural mouldings according to claim 2, wherein said polystyrene foam is formed to profile by hot wire cutting.

4. A method for producing continuous architectural mouldings according to claim 1, wherein said continuous web is selected from calendared or uncalendared plaster board facing paper and unbleached paper of a width sufficient for the laminating rollers to completely wrap the cover member about the core member.

5. A method for producing continuous architectural mouldings according to claim 1, wherein said adhesive lamination is by means of hot melt pressure sensitive adhesive.

6. Apparatus for producing architectural mouldings in accordance with the method of claims 1 to 5 and including:

feed means adapted to deliver said continuous core member having an outer surface formed to a selected profile;

supply means for said continuous web;

adhesive application means adapted to apply adhesive to a surface of said continuous web;

laminating rollers adapted to progressively and continuously laminate said core member and said cover member and having a working surfaces of respective profiles complementary to at least a portion of said outer surface.

7. Apparatus for producing architectural mouldings according to claim 6, wherein said laminating rollers comprise roller assemblies including support rollers and a roller having the shape of a solid of rotation of a profile complementary to at least a part of the core member profile, the architectural moulding being formed and supported by said roller assemblies.

8. Apparatus for producing architectural mouldings according to claim 7, wherein said roller assemblies comprise a plurality of roller stations adapted to progressively form the cover member about the core member.

9. Apparatus for producing architectural mouldings according to claim 8, wherein said roller assemblies comprise a first roller assembly adapted to laminate the cover member to a key indexing portion of the core member to form a moulding assembly which passes to said plurality of roller stations.

10. Architectural moulding produced by the apparatus of claim 6 and wherein said said profile includes an outer face profile and a mounting surface profile, said outer face profile being selected to be complementary to itself whereby mouldings may be maintained in face to face contact.

* * * * *